United States Patent [19]

Kostanecki

[11] 4,280,257

[45] Jul. 28, 1981

[54] CLASP FOR ADJUSTABLE WATCH BAND

[75] Inventor: Andrew T. Kostanecki, Darien, Conn.

[73] Assignee: Timex Corporation, Waterbury, Conn.

[21] Appl. No.: 41,578

[22] Filed: May 23, 1979

[51] Int. Cl.[3] ..... A44B 5/00; A44B 5/18

[52] U.S. Cl. ..... 24/206 R; 24/265 WS; 59/80; 224/176; 224/221

[58] Field of Search ..... 24/265 WS, 206 R, 187, 24/186, 703; 224/176, 175, 221, 267; 59/80, 82, 85

[56] References Cited

U.S. PATENT DOCUMENTS

| | | | |
|---|---|---|---|
| 1,779,068 | 10/1930 | Krementz | 24/206 R |
| 2,401,297 | 6/1946 | Forstner | 24/265 WS |
| 3,429,142 | 2/1969 | Brunet | 224/176 |

*Primary Examiner*—Alexander Grosz

*Attorney, Agent, or Firm*—Edward J. Timmer

[57] ABSTRACT

An improved clasp is provided for an adjustable watch band having overlapping strands, each comprising transversely abutting links, to releasably connect the strands together on the wrist of the wearer. The clasp includes a decorative cover member attached to the free end of the first strand with the cover member having one or more transversely oriented, preferably C-shaped hooks projecting therefrom to effect releasable engagement around links of the second strand.

3 Claims, 5 Drawing Figures

CLASP FOR ADJUSTABLE WATCH BAND

FIELD OF THE INVENTION

The invention relates to a clasp for flexible bracelets and, in particular, for use with adjustable wristwatch bands having transversely abutting links.

DESCRIPTION OF THE PRIOR ART

Various types of flexible wrist watch bands adjustable in length to suit the wrist of the wearer are illustrated in the Krementz U.S. Pat. No. 1,779,068 issued Oct. 21, 1930; the Fassnacht U.S. Pat. No. 1,851,823 issued Mar. 29, 1932 and the Brunet Pat. No. 3,429,142 issued Feb. 25, 1969. In general, these types of adjustable bands include two strands which are attached to the lugs on the opposite sides of a watch case and which overlap one another to various degrees depending upon the amount of length adjustment required in the band.

The patents further illustrate clasp arrangements for releasably connecting the overlapping strands of the band together after the length adjustment is made. In the Krementz and Brunet patents, the clasp typically comprises a so-called terminal plate hinged to the free end of one strand and having at least one pair of spring forks or claws which are spaced apart such they can be depressed onto opposite transverse sides of a link in the other strand in an elastic snap-fit engagement. In this case, the elastic or spring-like properties of the pair of forks or claws provide a clamping action against each of the transverse sides of the link and thereby maintain a clasped relation. In each patent, the free end of the other strand of the band includes a pivotable guide loop through which the strand carrying the clasp passes.

In the Fassnacht patent, the end of one strand includes a pivotable clamp for connecting the overlapping strands together at one point and the end of the other strand includes a locking member having spring-biased side teeth for gripping the strands together at a second point.

The Fontana U.S. Pat. No. 3,913,182 issued Oct. 21, 1975, illustrates a clasp for a nonexpansible wrist watch bracelet having two strands which abut. The clasp includes a first metal body hinged to the free end of one strand and a second metal body fastened to the free end of the other strand. The first metal body includes a hook which in the clasped condition is received in a slot in the second metal body. A pawl is provided in the second body to release the hook when the bracelet is to be removed from the wrist of the wearer.

SUMMARY OF THE INVENTION

The present invention provides an inproved clasp which is especially useful with adjustable watch bands of the type having first and second overlapping strands to permit length adjustment of the band to suit the wrist of the wearer wherein the strands are formed of transversely abutting links along the length of the strand. The clasp of the invention enables releasable engagement of the first and second strands together by effective hooking action rather than elastic snap-fit or other engagement schemes of the prior art.

Briefly described, the clasp includes a decorative cover member attached to the free end of the first strand in overlapping relation to one side of the second strand with one or more transversely aligned hooks projecting from the cover member toward the second strand. Each hook is adapted for insertion between the abutting links of the second strand with a portion of each hook overlapping one of the abutting links on the other side of the second strand after insertion, thereby providing effective hooking action around one or more links of the second strand to releasably connect the overlapping strands together.

Each hook typically includes an optional horizontal wall which rests against the side of the second strand facing the first strand, an upright wall extending from the horizontal wall and inserted between the abutting links of the second strand, and an oblique wall projecting from the upright wall on the other side of the second strand at such an angle that it overlaps the abutting link disposed beneath the cover member.

In a particular preferred embodiment of the invention, the clasp is a unitary construction with the decorative cover member including one or more transversely oriented loops on one side for connection between transverse links forming the free end of the first strand and one or more of the aforementioned transversely oriented hooks adjacent the other side to effect releasable engagement with the links of the second strand. Preferably, the decorative cover member includes one more strip members projecting therefrom with each strip being suitably bent to form a loop on one side and a hook adjacent the other side of the cover member.

DESCRIPTION OF THE PREFERRED EMBODIMENTS

Figure 1:
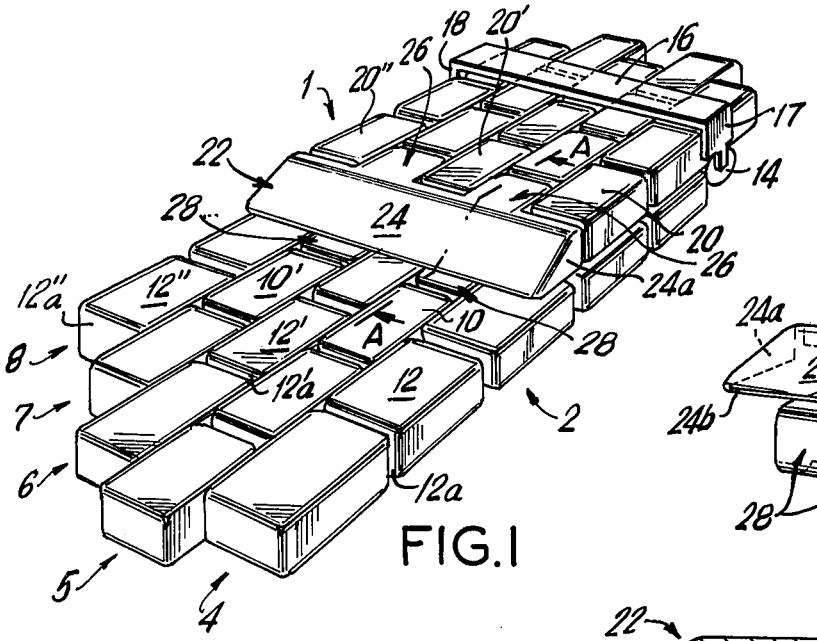
FIG. 1 is a perspective view of an adjustable watch expansion band with abutting transversely aligned links and a preferred clasp of the invention.

In FIG. 1, the overlapping strands 1 and 2 form an adjustable expansion band for a wrist watch with the strand 2 usually being against the wrist of the wearer. Although not shown, the other end of each strand is attached in well known fashion to the spaced transverse lugs on opposite sides of a watch case. Each strand is illustrated as comprising longitudinal rows of parallelpipedal links or elements which are staggered relative to those in the adjacent row; e.g. rows 4–8 of strand 2. As shown, there recurs an alternating pattern in which two or three parallepipedal links are aligned transversely, for example links 10 and 10' and links 12, 12', and 12''.

As can be seen, the transversely aligned links have transverse ends, e.g. 12*a*, 12'*a*, 12''*a*, which abut those of their neighboring links in the same longitudinal row. The links of each strand are connected together by suitable leaf springs (not shown) or the like so that the strands and thus the band can expand longitudinally.

Strand 2 includes a transversal element 14 secured to its free end with a guide loop 16 pivoted or otherwise secured to the transversal element by its side walls 17 and 18. As is apparent, strand 1 passes through the guide loop 16 and includes terminal links 20,20', and 20'' at the free end to which the clasp 22 of the invention is pivotably mounted in overlying relation to the top side of strand 2.

Figure 2:
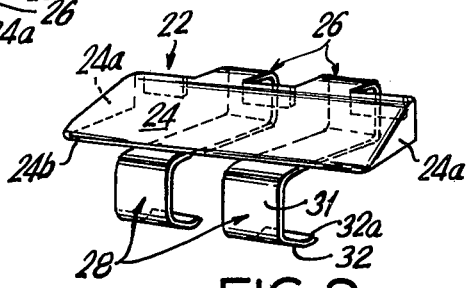
FIG. 2 is a perspective view of a preferred clasp of the invention.
Figure 3:
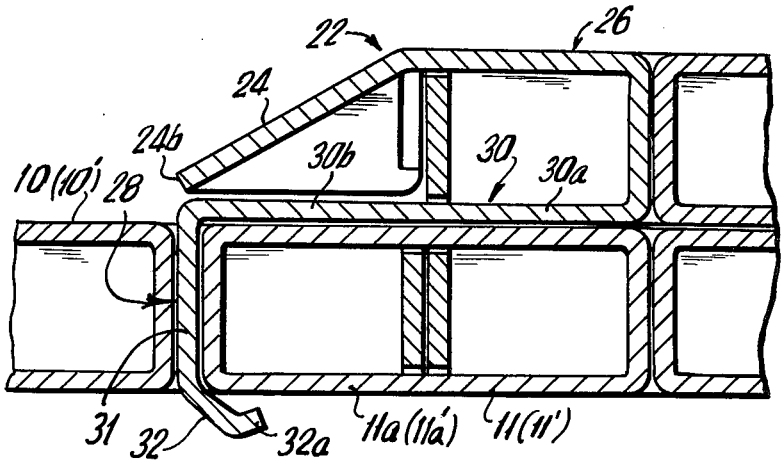
FIG. 3 is a partial cross-section along line A—A of FIG. 1.

The clasp is shown most clearly in FIGS. 2 and 3. It comprises an angular decorative cover member 24, typically made of stainless steel strip, which may include triangular shaped sidewalls 24*a* for appearance purposes. The angle of the decorative cover member is selected to insure that the side connected to strand 1 (loop-side) is substantially coplanar with the top surface of that strand and that the opposite side (hook-side) is disposed downwardly toward the top surface of strand 2, stopping slightly thereabove as shown in FIG. 3 to provide an edge or tab 24*b* by which the cover member can be lifted upwardly by the wearer to disengage the clasp. This angular decorative cover member is preferred since it imparts a more finished and aesthetically pleasing appearance to the clasp than other possible configurations which might be used in the invention.

As shown in the Figures, the decorative cover member includes two spaced strip members projecting therefrom, each strip being suitably bent to form transverse loops 26 on one side for connection between terminal elements 20, 20', 20'' of strand 1 by suitable means such as a leaf spring or bar and transverse hooks 28 adjacent the other side to releasably engage around the links forming strand 2. Of course, the width of the projecting bent strips is slightly less than the width of the individual links of the strands so that the loops will fit between elements 20, 20', and 20'' of strand 1 and the hooks between the ends of abutting links 10 and 11 and 10' and 11' of strand 2. As shown in FIG. 3, the loop 26 and hook 28 of each strip member share a common horizontal wall portion 30 which lies beneath the decorative plate member 24 and extends thereunder atop strand 2. The horizontal wall has a length equal to the length of link 11 (11'). One half 30*a* of the horizontal wall completes the loop 26 whereas the other half 30*b* completes a preferred form of hook 28. In this way, a one-piece clasp is provided.

Each hook 28 of the clasp preferably is C-shaped and includes a horizontal wall 30*b* which rests atop the strand 2, an upright wall 31 which is inserted between the ends of abutting links of strand 2 and which is more or less clamped between the abuttting links by the elastic action of the strand, and an oblique wall 32 projecting from the upright wall on the bottom side of the second strand at such an angle that it at least partially overlaps the lower longitudinal wall 11*a* (11'*a*) of abutting link 11 (11') which is disposed beneath cover member 24, e.g. as shown in FIG. 3. The clamped upright wall 31 of the clasp prevents disengagement of the clasp from circumferential tensile forces on the wrist of the wearer whereas the oblique wall 32 resists disengagement from outward radial forces. The horizontal wall is adapted to rest on the top longitudinal wall of the link 11 (11') and in conjunction with the upright wall portion to maintain the clasp and strands near the clasp in more less flat registry as shown in FIG. 3. Together, walls 30*b*, 31 and 32 effectively prevent disengagement against almost any combination of forces to which the band is normally exposed.

To facilitate insertion of the hooks between the abutting links, each oblique wall 32 is provided with a curled end 32*a* which functions to spread the links apart as the hooks are inserted.

Figure 4:
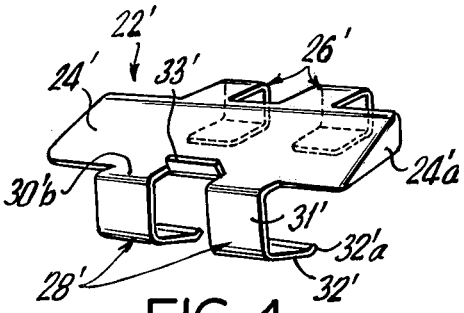
FIG. 4 is a perspective view of another clasp embodiment.

FIG. 4 illustrates another embodiment of the clasp for use with the expansion band illustrated in FIG. 1 with like numerals referring to like features. It is apparent that the clasp contains the same features as that already described with the exception that each of the transverse loops 26' and hooks 28' is made of an individual bent strip projecting from the decorative cover member 24' rather than a loop and hook pair being formed from one common bent strip. Between the hooks 28' is an upwardly projecting finger tab 33' by which the clasp can be manually disengaged by the wearer. As before, each hook includes a horizontal wall 30'*b*, an upright wall 31' extending therefrom and an oblique wall 32' with a curled end 32'*a*.

Figure 5:
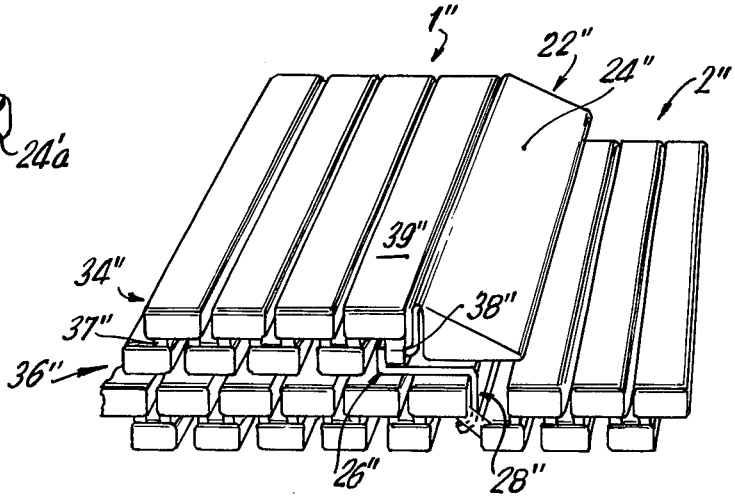
FIG. 5 is a perspective view of an adjustable-expansible watch band with another preferred clasp of the invention.

FIG. 5 shows a clasp for use with an expansion band comprising rows of links perpendicular to the length band. Each strand of the band comprises a top row 34'' of such links and a bottom row 36'' staggered relative to the top row and connected together by a suitable springs 37''. As shown, the clasp comprises an angular decorative cover member 24'' like that described above having a transverse loop 26'' on one side and a transverse hook 28'' near the other side formed by a suitably bent strip member projecting from the cover member. The loop 26'' is secured to the top strand 1'' by terminal spring 38'' projecting from the end link 39'' of the strand. The hook 28'' extends almost the complete width of the band and releasably engages a top link in strand 2'' as shown. The hook 28'' includes the preferred features already discussed with respect to the above embodiments. A clasp like that shown in FIG. 5 can also be used with expansion bands having strands each comprised of only one row of transverse links connected together by suitable springs.

Since there is no elastic snap-fit engagement involved in the clasp of the invention, the clasp can be made of strong rigid material which imparts high strength to the loops and hooks, thereby providing a secure clasping engagement.

Although the invention has been shown and described with respect to the illustrative embodiments, it will be understood by those skilled in the art that changes and addition in the form and detail thereof may be made without departing from the spirit and scope of the invention.

We claim:

1. In an adjustable wristwatch band having first and second strands each with a free end in partially overlapping relation to the other, each strand being formed of spaced transverse links abutting one another along the length of the strand, an improved clasp for releasably connecting the overlapping strands together, said clasp comprising a decorative cover member attached to the free end of the first strand in overlapping relation to one side of the second strand, said cover member having a projecting strip member suitably bent to form a loop along one side for connection to the free end of the first strand and to form a transversely aligned hook adjacent the other side projecting toward the second strand with an intermediate portion of the strip member extending beneath the cover member from one side thereof to the other to complete the loop and hook and connect them together, the hook being adapted for insertion between abutting links of the second strand with a portion of said hook partially overlapping one of said abutting links on the other side of the second strand after insertion so that effective hooking action is provided around at least one link of the second strand.

2. The band of claim 1 wherein the hook comprises a substantially horizontal wall disposed adjacent said one side of the second strand, said wall being formed by the intermediate portion of said strip member, an upright wall extending from the horizontal wall and adapted for insertion between abutting links of said second strand, and an oblique wall extending from the upright wall on the other side of said second strand at such an angle that it partially overlaps the abutting link beneath said cover member.

3. In an adjustable watch expansion band having first and second strands each with a free end in partial overlapping relation to the other, each strand being formed of abutting links of parallelpipedal shape arranged in longitudinal rows alternately staggered with respect to one another in the transverse direction to establish a recurring pattern of transversely aligned links, an improved clasp for releasably connecting the overlapping strands together, said clasp comprising a decorative cover member attached to the free end of the first strand in overlapping relation to one side of the second strand, said cover member having multiple transverse strip members projecting therefrom suitably bent so that each strip member forms a loop transversely aligned along one side for connection between transversely aligned links forming the free end of the first strand and so that each strip member also forms a hook transversely aligned adjacent the other side of the cover member for hooking around transversely aligned links in alternating rows of the second strand to clasp the strands together with each strip member also including an intermediate wall extending longitudinally beneath the cover member so that a portion of said intermediate wall completes the loop formed by that strip member and the remaining portion completes the hook formed by that strip member.

* * * * *

UNITED STATES PATENT AND TRADEMARK OFFICE

CERTIFICATE OF CORRECTION

PATENT NO. : 4,280,257

DATED : July 28, 1981

INVENTOR(S) : Andrew T. Kostanecki et al.

It is certified that error appears in the above—identified patent and that said Letters Patent is hereby corrected as shown below:

On The Title Page, item (75) insert -- George Mileos Riverdale, N. Y. --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*